United States Patent [19]

Jozuka et al.

[11] 4,426,168

[45] Jan. 17, 1984

[54] SERIAL IMPACT PRINTER FOR MULTICOLOR PRINTING

[75] Inventors: Masao Jozuka; Kazuhiro Ohmura, both of Nagoya, Japan

[73] Assignee: Brother Kogyo Kabushiki Kaisha, Nagoya, Japan

[21] Appl. No.: 467,337

[22] Filed: Feb. 17, 1983

Related U.S. Application Data

[63] Continuation of Ser. No. 238,086, Feb. 25, 1981, abandoned.

[30] Foreign Application Priority Data

Mar. 12, 1980 [JP] Japan ..... 55-31165

[51] Int. Cl.[3] ..... B41J 35/16

[52] U.S. Cl. ..... 400/224; 400/124; 400/208; 400/224.1; 400/240.4

[58] Field of Search ..... 400/124, 224, 224.1, 400/240.3, 240.4, 208

[56] References Cited

U.S. PATENT DOCUMENTS

| | | | |
|---|---|---|---|
| 3,858,705 | 1/1975 | Reitano | 400/240.4 X |
| 4,088,218 | 5/1978 | Depew | 400/196.1 X |
| 4,119,383 | 10/1978 | Watanabe et al. | 400/124 |
| 4,165,191 | 8/1979 | Dickson et al. | 400/224 X |
| 4,209,261 | 6/1980 | Bell et al. | 400/224 X |
| 4,231,290 | 11/1980 | Shenoha | 400/224 X |
| 4,280,767 | 7/1981 | Heath | 400/240.4 X |

*Primary Examiner*—Paul T. Sewell

*Attorney, Agent, or Firm*—Browdy and Neimark

[57] ABSTRACT

A serial impact printer capable of performing multicolor printing at high speed. In this printer an inked ribbon divided into multiple colored bands each along the longitudinal direction thereof is arranged to extend and move in a direction intersecting the print line. A print head assembly is provided with print wire units arranged along the print line, as many in number as the number of the colored bands. Each of the print wire units comprises a plurality of print wires and is disposed in opposition to each of the colored bands respectively.

In this arrangement and method multicolored impact serial printing can be performed, just as in conventional monocolor impact printing, without any color change motion of the multicolor inked ribbon or of the print head.

8 Claims, 4 Drawing Figures

SERIAL IMPACT PRINTER FOR MULTICOLOR PRINTING

REFERENCE TO RELATED APPLICATION

This application is a continuation of co-pending application Ser. No. 238,086, filed Feb. 25, 1981, now abandoned.

BACKGROUND AND SUMMARY OF THE INVENTION

This invention relates to a serial impact printer for multicolor printing and more particularly to a serial impact printer capable of performing multicolor printing at high speed.

A serial impact printer for multicolor printing is generally provided with an electronic memory for storing printing data for one line so as to conducting printing, after having stored the printing data for the whole line, by starting from either the right side or the left side, in order and continuously. The print head assembly is therefore moved continuously in a raster pattern without any halting or stoppage in the course of printing.

As a serial printer of this kind for performing multicolor impact printing, U.S. Pat. No. 4,073,371 is prior art wherein one color band, for example, the red band out of a multicolored inked ribbon having several color bands is selected to be printed at first in one given print line from right to left; then another color band, for example, the blue band is selected to be printed next in the same print line from right to left; and then still another color band, for example, the yellow band is selected for a similar course of printing. The printing method of selecting color bands like this in order followed by the repeated printing for a given line is disclosed in the above-mentioned patent.

This method is disadvantageous as it reduces the printing speed in comparison to ordinary monocolor, mainly black, impact printing.

This invention is aimed at providing a serial impact printer for multicolor printing, which eliminates the conventional disadvantage, and in which the color change mechanism for the multicolor inked ribbon is done away with or discarded and the printing speed is increased. The invention comprises a device which embodies a unique relative arrangement between the multicolor inked ribbon and the print head assembly. For the purpose of achieving this object, an inked ribbon in an impact printer for multicolor printing of this invention is divided into multiple colored bands each along the longitudinal direction thereof, and is arranged to extend and move in a direction intersecting the print line. A print head assembly is provided with print wire units arranged along the print line as many as the number of the above-mentioned colored bands, and each of the print wire units comprises a plurality of print wires and is disposed always in opposition to each of the colored bands respectively.

In this arrangement and method multicolored impact serial printing can be performed, just like in the conventional monocolor impact printing, without conducting the color change in the multicolor inked ribbon. In this way printing of colored graphics as well as colored letters can be carried out without decreasing the printing speed at all.

BRIEF DESCRIPTION OF THE DRAWING

Some preferred embodiments of this invention will be described hereunder with reference to the accompanying drawing in which.

DETAILED DESCRIPTION OF THE PREFERRED EMBODIMENTS

Figure 1:
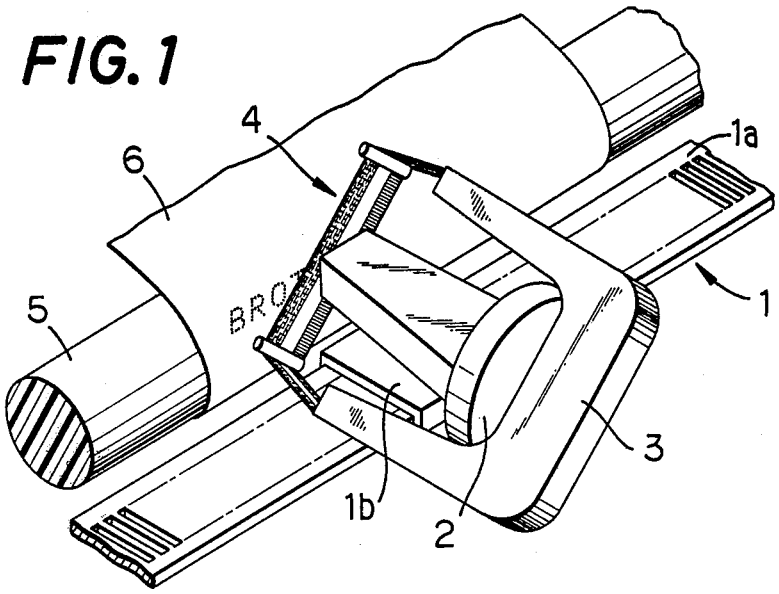
FIG. 1 is a perspective view of an embodiment of a serial impact printer for multicolor printing of this invention.

FIG. 1, is a perspective view of a printing portion of a serial impact printer for multicolor printing according to this invention. Numeral 1 designates a linear motor consisting of a stator 1*a* and a slider 1*b* movably mounted thereon. This sort of linear motor 1 is well known, for example, in U.S. Pat. No. 4,044,881, thus requiring no detailed description herein. On the slider 1*b* a print head assembly 2 is attached, and a ribbon cassette 3 is attached thereon in turn. The former is made known, for example, in U.S. Pat. No. 4,073,371 and the latter is made known, for example, in U.S. Pat. No. 4,091,913, so description thereof would be superfluous. In this embodiment, the slider 1*b* of the linear motor 1 concurrently functions as a carriage means.

Figure 2:
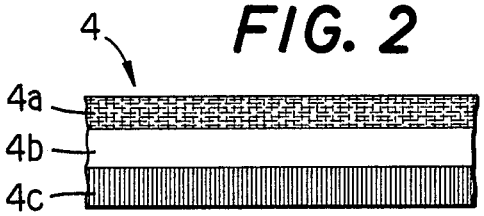
FIG. 2 is a schematic view of a multicoor inked ribbon.

An endlss tricolored ribbon 4 having three color bands, as shown in FIG. 2, of red, blue, and yellow is contained in the ribbon cassette being folded in multiple piles. This tricolored ribbon 4 is obliquely set on the tip of the print head assembly 2. On a platen 5 a print paper 6 is set for being printed.

Figure 3:
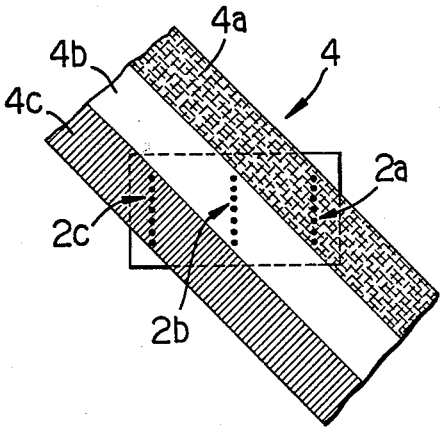
FIG. 3 is a schematic view showing the positional relation between the print head assembly and the ribbon.

FIG. 3 shows the positional relation between the tricolored ribbon 4 and the print head assembly 2. The tricolored ribbon 4 is provided with three color bands, as can be seen in FIG. 2 and FIGS. 3, 4*a*, 4*b*, and 4*c* from top to bottom in order, for example, red, blue, and yellow, occupying respectively in the longitudinal direction of the ribbon one third the width of the ribbon 4. On the other hand, the print head assembly 2 is provided on the front side tip thereof with three units of print wires 2*a*, 2*b*, and 2*c* arranged side by side as shown in FIG. 3. In each of the print wirde units arranged in parallel seven print wires are respectively contained in a vertically aligned style. Printing of letters or patterns for one print line is performed with a selected wire or wires out of those vertically aligned seven print wires by making corresponding dots. The three print wire units, 2*a*, 2*b*, and 2*c*, arranged in parallel on the tip of the print head assembly 2 are respectively faced to each of the color bands, 4*a*, 4*b*, and 4*c*. In other words, a number of print wire units, each including seven print wires, are arranged along a print line on the platen 5. The number of wire units equals the number of colored bands such as 4*a*, 4*b*, and 4*c*, in the ribbon. The seven print wires of each print wire unit are arranged or aligned along a segment of a straight line extending from one edge to the other of each colored band 4*a*, 4*b*, and 4*c*. As the segment is oblique to the longitudinal direction of the inked ribbon 4, the length of the segment is larger than the width of each colored band with a result of making the arrangement of the plural print wires in opposition to the relatively narrow colored band easy. The obliqueness of the segment against the longitudinal direction, i.e., the moving direction of the inked ribbon, allows almost all parts of the inked ribbon to be effectively used, leaving little wasted ribbon after the printing operation.

Printing command signals are generated by a not shown controller in response to the movement of the slider 1*b* according to printing data stored in an electronic memory. A wire activating device (not shown) selectively activates the wires according to the command signals to make each of the print wire units 2*a*, 2*b*, and 2*c* perform respectively printing in its proper color, such as red-dot printing by the first unit 2*a*, blue dot printing by the second unit 2*b*, and yellow dot printing by the third unit 2*c*. The tricolored ribbon 4 is fed in one direction at a constant speed as the print head assembly 2 is moved. During a single shifting of the print head assembly 2 along a print line all of the print operation by the color-dots by all of the print wire units 2*a*, 2*b*, and 2*c* are finished by means of color selection data and wire designating data of the printing commands. Furthermore, each of the print wire units can be so operated as to overlap different colored dots in printing for obtaining combined color dotting in addition to the ordinary separated dotting.

Figure 4:
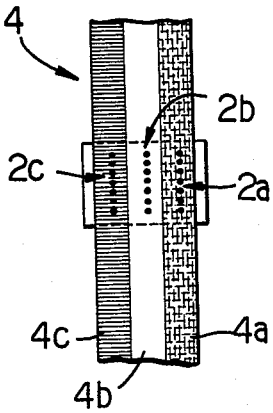
FIG. 4 is a schematic view of a multicolor inked ribbon used for another embodiment of the printer.

This invention should not be interpreted to be limited to the above embodiment which is disclosed only by way of example. Many modifications and alterations can be made by those skilled in the art within the spirit of this invention. For example, disposing plural rows of print wires for each print wire unit, or arranging and feeding a multicolored ribbon perpendicular to the movement direction of the print head assembly 2 as shown in FIG. 4, are both permissible.

While the invention has been described in detail above, it is to be understood that this detailed description is by way of example only, and the protection granted is to be limited only within the spirit of the invention and the scope of the following claims.

What is claimed is:

1. In an impact printer having platen means for supporting a print paper, a ribbon cassette containing an elongated inked ribbon, carriage means, carriage driving means coupled to the carriage means for reciprocally moving the carriage means relative to said print paper along a print line, and a print head assembly mounted on the carriage means to print characters along the print line on the paper, the improvement wherein, said inked ribbon is divided into multiple colored bands each along the longitudinal direction thereof, said print head assembly including plural print wire units arranged along the print line, the number of said units being equal to that of said colored bands, each of said print wire units comprising a plurality of print wires, and said ribbon cassette is mounted on said carriage means, said inked ribbon extending and moving in a direction intersecting the print line, each of said print wire units being disposed always in opposition to a respective one of said colored bands and being movable past any points on said print line at different timings together with the respective colored band and without a vertical shifting of said ribbon, whereby the multicolor printing of said characters is performed in selected different colors even within the same print line by means of selective actuation of said units through a single shifting of said carriage means along the print line.

2. The impact printer of claim 1, wherein said inked ribbon is arranged obliquely to the line of movement of said carriage along the print line.

3. The impact printer of claim 1, wherein said inked ribbon is arranged perpendicularly to the line of movement of said print head assembly along the print line.

4. The impact printer of claim 1, wherein said plurality of print wires of each said print wire unit are arranged along one straight line.

5. The impact printer of claim 1, wherein said plurality of print wires of each said print wire unit are arranged along a segment of a straight line extending from one edge to the other of said each colored band, said segment being longer than the width of each said colored band.

6. The impact printer of claim 1, wherein said plurality of print wires of each said print wire unit are arranged along a line oblique to the line of movement of said inked ribbon.

7. The impact printer of claim 1, wherein said inked ribbon is provided with three colored bands.

8. An impact printer having a platen for supporting a print paper, a ribbon cassette containing an elongated inked ribbon, a carriage, carriage driving means coupled to the carriage for reciprocally moving the carriage relative to said print paper along a print line, and a print head assembly mounted on the carriage to print characters along the print line on the paper, the improvement comprising:

said inked ribbon being divided into multiple colored bands each extending along the longitudinal direction thereof and moving obliquely to the line of movement of said carriage along said print line;

said print head assembly including a plurality of print wire units arranged along the print line, the number of said units being equal to that of said colored bands, each of said print wire units comprising a plurality of print wires which are arranged along a segment of a straight line extending from one edge to the other of said each colored band, said segment being longer than the width of each said colored band; and said ribbon cassette being mounted on said carriage in fixed relation with said print head assembly, said plurality of print wires of said each print wire unit being kept in opposition to said segment of the straight line extending from said one edge to said other of the respective one of said colored bands, and the line of arrangement of said print wires of said each print wire unit being movable past any points on said print line at different timings together with the respective colored band without a vertical shifting of said ribbon, whereby the multicolor print of said characters is performed in selected different colors even within the same print line by means of selective actuation of said units through a single shifting of said carriage along the print line.

* * * * *